US008224192B2

(12) United States Patent
Watanabe

(10) Patent No.: US 8,224,192 B2
(45) Date of Patent: Jul. 17, 2012

(54) IMAGE FORMING APPARATUS

(75) Inventor: Takahiro Watanabe, Minato-ku (JP)

(73) Assignee: Canon Kabushiki Kaisha (JP)

( * ) Notice: Subject to any disclaimer, the term of this patent is extended or adjusted under 35 U.S.C. 154(b) by 378 days.

(21) Appl. No.: 11/759,437

(22) Filed: Jun. 7, 2007

(65) Prior Publication Data

US 2007/0286615 A1 Dec. 13, 2007

(30) Foreign Application Priority Data

Jun. 12, 2006 (JP) ..... 2006-162805

(51) Int. Cl.
*G03G 15/00* (2006.01)

(52) U.S. Cl. ..... 399/21; 399/33

(58) Field of Classification Search ..... 399/21, 399/33

See application file for complete search history.

(56) References Cited

U.S. PATENT DOCUMENTS

| | | | | |
|---|---|---|---|---|
| 5,828,924 | A * | 10/1998 | Fukada et al. | 399/16 |
| 7,403,721 | B2 * | 7/2008 | Yamada | 399/21 |
| 2004/0161252 | A1 * | 8/2004 | Hirai et al. | 399/21 |

FOREIGN PATENT DOCUMENTS

| | | | | |
|---|---|---|---|---|
| JP | 7-140836 | A | | 6/1995 |
| JP | 2004-210494 | A | | 7/2004 |
| JP | 2005066969 | A | * | 3/2005 |
| JP | 2005-173041 | A | | 6/2005 |
| JP | 2006-124129 | A | | 5/2006 |

OTHER PUBLICATIONS

Japanese Office Action dated Feb. 10, 2012 in corresponding JP 2006-162805.

Japanese Office Action in corresponding JP 2006-162805, dated Aug. 22, 2011.

* cited by examiner

*Primary Examiner* — Matthew G Marini
*Assistant Examiner* — Allister Primo
(74) *Attorney, Agent, or Firm* — Rossi, Kimms & McDowell LLP

(57) ABSTRACT

An image forming apparatus forms an image by fixing, on a recording medium, a toner image formed by an image forming unit. The image forming apparatus includes a determination unit which determines whether a delay has occurred during conveyance of a recording medium, based on the detection result of the recording medium discharged from a fixing unit for fixing a toner image on the recording medium, and a control unit which controls the operation of the image forming apparatus based on the determination result of the determination unit and a determination result indicating whether a jam processing operation was executed for the fixing unit.

2 Claims, 5 Drawing Sheets

IMAGE FORMING APPARATUS

BACKGROUND OF THE INVENTION

1. Field of the Invention

The present invention relates to an image forming apparatus.

2. Description of the Related Art

Conventionally, when a jam occurs at the fixing roller of a fixing unit in an image forming apparatus and no jam processing is performed, a recording medium may wind around the fixing roller in during a recovery or warm-up operation, thus causing a problem. Japanese Patent Laid-Open No. 7-140836 discloses a structure for preventing a recording medium from winding around the fixing roller, by arranging sensors upstream and downstream (recording medium feeding and discharge sides) of the fixing unit, detecting, using these sensors, a recording medium which remains in an area upstream or downstream from the fixing unit, and stopping a fixing roller driving motor.

Such a conventional technique which uses sensors arranged upstream and downstream from the fixing unit is effective in an image forming apparatus operating at medium to low speed (e.g., 10 to 60 sheets per minute) processing capability. However, in an image forming apparatus capable of high-speed processing of 80 or more sheets per minute, even if sensors are arranged upstream and downstream from the fixing roller, it takes a long time after a jam has been detected before the fixing roller drive motor stops. Accordingly, the recording medium cannot be stopped (cannot be detected) at the detection positions of the upstream and downstream sensors. In this case, if the sensors do not detect a recording medium remaining near the fixing roller, the control unit of the image forming apparatus erroneously determines on the basis of the detection results of the sensors that the image forming apparatus is in a normal state.

Furthermore, if the image forming apparatus is power-cycled while the sensors are not detecting any recording medium, the image forming apparatus will execute the warming-up operation and the like. Accordingly, an undetected recording medium remaining at the fixing roller will undesirably wind around the fixing roller.

SUMMARY OF THE INVENTION

The present invention has been made in consideration of the above problems, and has as its object to provide an image forming apparatus which prevents a recording medium from winding around a fixing roller.

According to one aspect of the present invention, an image forming apparatus which determines whether a jam occurs during conveyance of a recording medium, based on a detection result indicating whether the recording medium is discharged from a fixing unit for fixing a toner image onto the recording medium, the apparatus comprises:

a cancellation determination unit which determines whether a jam state has been canceled, wherein when the image forming apparatus is turned off and then on, if the cancellation determination unit does not determine that a user has directly executed a jam processing operation for the fixing unit, the cancellation determination unit prevents the image forming apparatus from starting an operation, and if the cancellation determination unit determines that the user has executed the jam processing operation, the cancellation determination unit allows the image forming apparatus to restart the operation.

The present invention can prevent a recording medium from winding around the fixing roller.

Further features of the present invention will become apparent from the following description of exemplary embodiments (with reference to the attached drawings).

DESCRIPTION OF THE EMBODIMENTS

Preferred embodiments of the present invention will be described below with reference to the accompanying drawings. However, building components described in the following embodiments are merely an example, and should not be construed as limiting the scope of the present invention.

Figure 4:
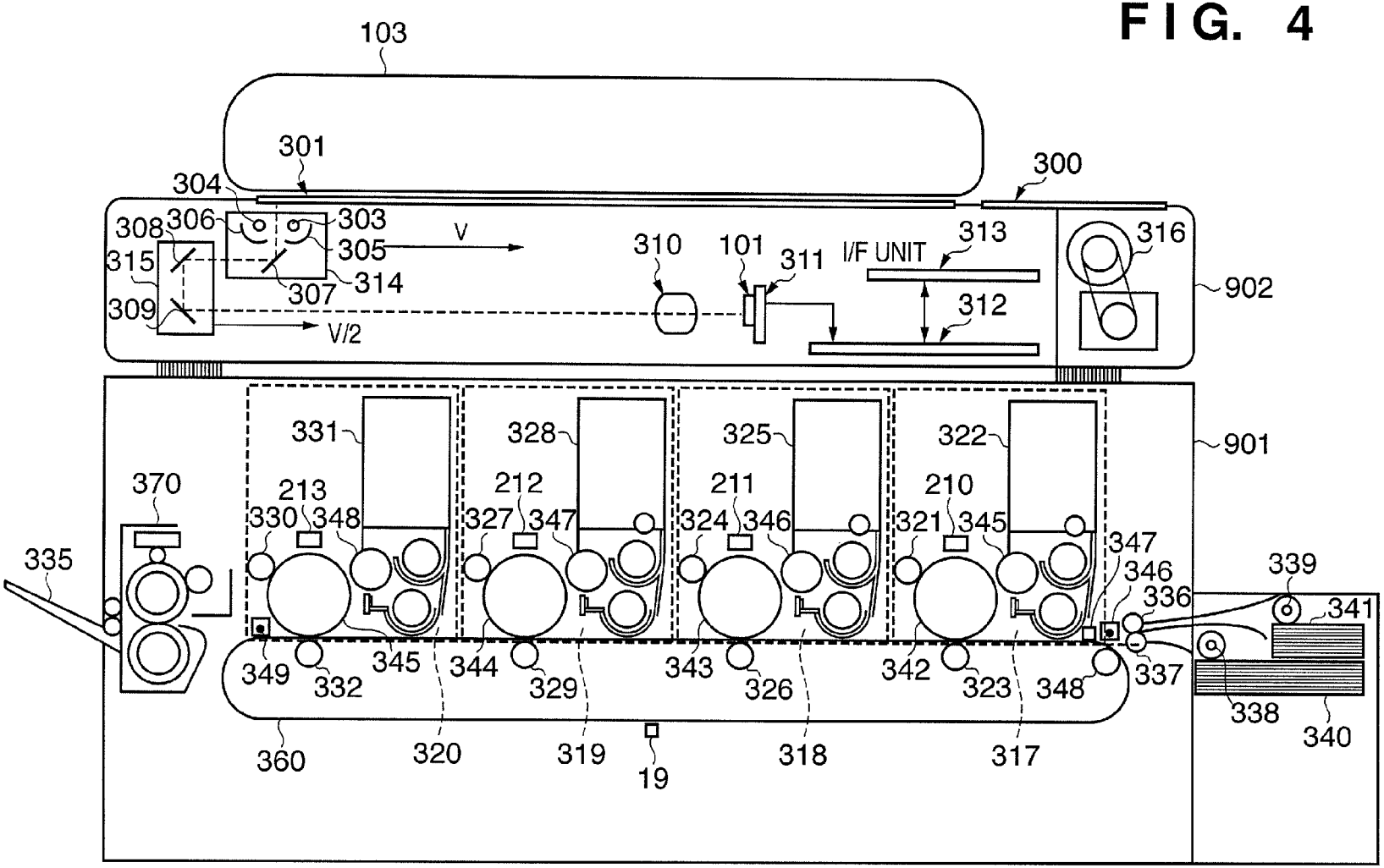
FIG. 4 is a view showing the overall arrangement of the image forming apparatus according to the embodiment of the present invention.

FIG. 4 is a view showing the overall arrangement of an image forming apparatus according to the embodiment of the present invention. The image forming apparatus includes a reader 902 and printer 901.

The reader 902 includes a CCD 101, a substrate 311 on which the CCD 101 is mounted, and a digital image processing unit 312.

An original is placed on an original plate (platen) 301. A document feeder (DF) 103 sequentially feeds a bundle of original sheets from an original table (not shown) to the original plate 301. Light sources (halogen lamps or fluorescent lamps) 303 and 304 illuminate the original. Reflectors 305 and 306 condense light from the light sources 303 and 304 onto the original. A carriage 314 houses the light sources 303 and 304, the reflectors 305 and 306, and a mirror 307. A carriage 315 houses mirrors 308 and 309. Note that the carriages 314 and 315 mechanically move at velocities V and V/2, respectively, (by the driving of a motor 316) in directions (indicated by the arrows shown in FIG. 4), perpendicular to the electrical scanning (main scanning) direction of the CCD 101, thereby scanning (sub-scanning) the entire surface of the original.

A lens 310 focuses light reflected by the original or projected light onto the CCD 101. As described above, the original on the original plate reflects light from the light sources 303 and 304, and the reflected light is guided to the CCD 101 and converted into an electrical signal.

The electrical signal (analog image signal) obtained by the CCD 101 is input to the image processing unit 312, and subjected to image processing.

An external interface (I/F) unit 313 is an interface with a computer and the like.

The arrangement of the printer 901 will be described next. Referring to FIG. 4, reference numeral 317 denotes a yellow image forming unit; 318, a magenta image forming unit; 319, a cyan image forming unit; and 320, a black image forming unit. Since these image forming units have the same arrangement, the arrangement of the yellow image forming unit 317 will be described in detail below, and a repetitive description of the remaining image forming units will be omitted.

In the yellow image forming unit 317, a motor is arranged behind a photoconductive drum 342 to rotationally drive the photoconductive drum 342. When this drum is irradiated with light from an optical control unit 210 such as a laser or an LED array, a latent image is formed on the surface of the photoconductive drum 342. A primary charger 321 charges the surface of the photoconductive drum 342 to a predetermined potential to prepare for the formation of a latent image. A developing unit 322 forms a toner image by developing the latent image on the photoconductive drum 342.

Note that the developing unit 322 includes a sleeve 345 for developing an image by applying a developing bias. A transfer charger 323 releases a charge from the reverse (back) side of a rotating conveyance member 360 and transfers a toner image onto the recording media on top of the rotating conveyance member 360. In this embodiment, since the transfer efficiency is high, no cleaner unit is arranged. However, a cleaner unit may be arranged near the photoconductive drum 342.

A procedure of forming an image on a recording medium will be described next. Recording media stored in cassettes 340 and 341 are conveyed one by one to a registration roller pair made up of rollers 336 and 337 by feed rollers 338 and 339. The registration roller pair made up of the rollers 336 and 337 supplies the recording medium to the rotating conveyance member 360 at image formation time. The fed recording medium is charged by a chucking charger 346. A rotating conveyance member driving roller 348 drives the rotating conveyance member 360, and charges the recording medium together with the chucking charger 346, thereby chucking the recording medium on the rotating conveyance member 360.

A sheet leading edge sensor 347 detects the leading edge of the recording medium on the rotating conveyance member 360. A detection signal from the sheet leading edge sensor 347 is sent from the printer 901 to the reader 902, and used as a sub-scanning synchronization signal when the reader 902 sends a video signal to the printer 901.

In order to correct for thickness nonuniformity of the rotating conveyance member 360 and prevent the recording medium from being placed on the seam of the rotating conveyance member 360 (when the rotating conveyance member 360 is a non-seamless belt or the like), a sensor 19 is arranged to detect the home position of the rotating conveyance member 360. By using the sensor 19, images can be formed at the same position every time. After that, the rotating conveyance member 360 conveys the recording medium, and the yellow, magenta, cyan, and black image forming units 317, 318, 319, and 320 forms toner images on the surface of the recording medium in the order of Y, M, C, and K. A recording medium that has passed through the black image forming unit 320 is charge-removed by a charge-removing/charging device 349 so as to be easily separated from the rotating conveyance member 360. The recording medium is then separated from the rotating conveyance member 360. A fixing unit 370 thermally fixes a toner image on the separated recording medium, and the recording medium is then discharged into a discharge tray 335.

Figure 1:
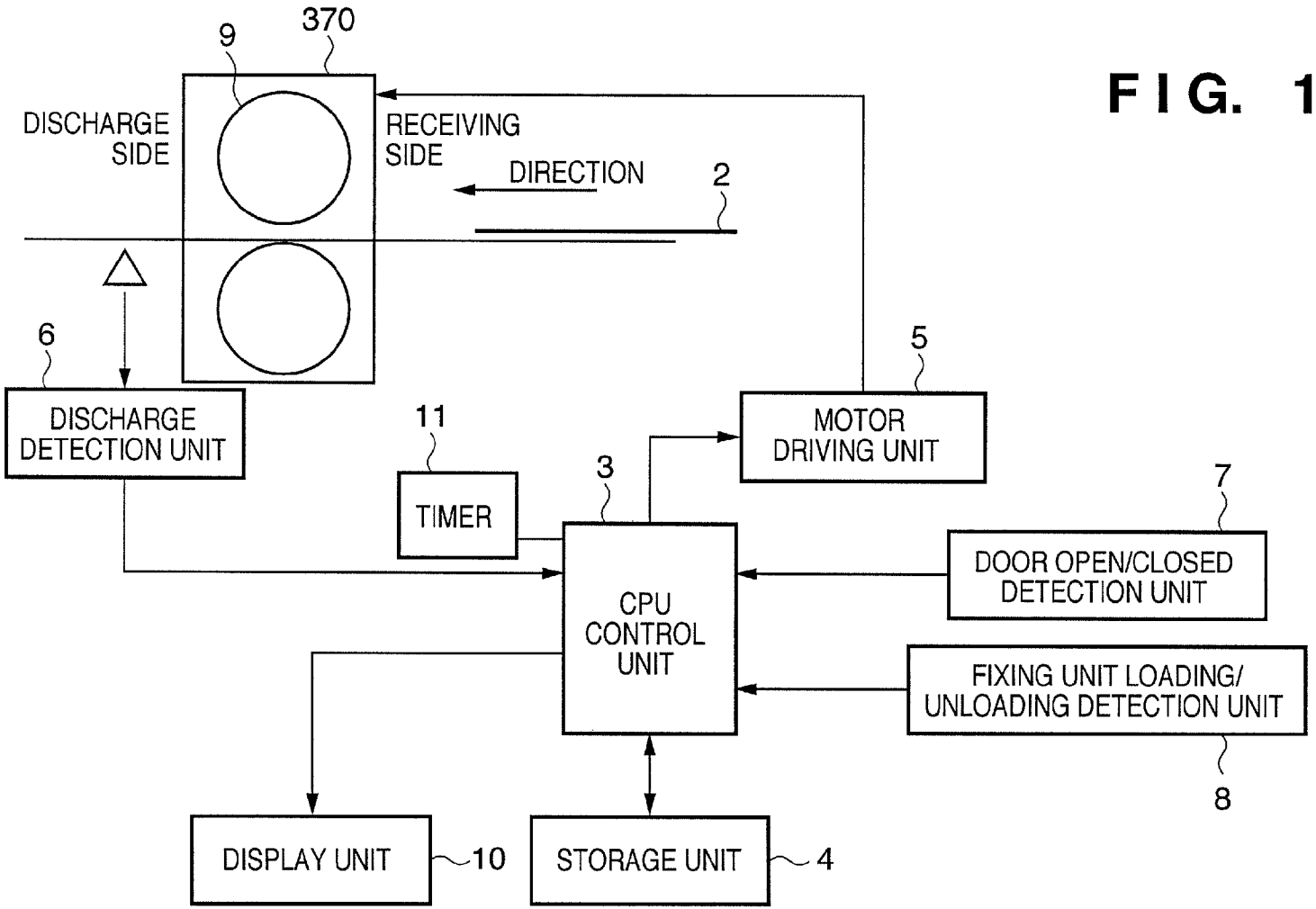
FIG. 1 is a block diagram for explaining the concrete arrangement of an image forming apparatus according to an embodiment of the present invention.

The concrete arrangement of the image forming apparatus according to the embodiment of the present invention will be described next with reference FIG. 1. A discharge detection unit 6 which comprises a discharge sensor and the like is arranged on the discharge side of the fixing unit 370. A recording medium 2 with toner images formed by the yellow, magenta, cyan, and black image forming units 317, 318, 319, and 320 as shown in FIG. 4 is conveyed to the receiving side of the fixing unit 370. A CPU control unit 3 allows a motor driving unit 5 to control a fixing roller 9 in the fixing unit 370. When the recording medium 2 is normally conveyed, the discharge detection unit 6 detects the recording medium 2 within a predetermined period of time after the start of image formation. When the discharge detection unit 6 does not detect the recording medium 2 within the predetermined period of time, the CPU control unit 3 determines that abnormal conveyance of the recording medium 2 has occurred—in other words, that the recording medium 2 may wind around the fixing roller 9 (=jam). In this case, the CPU control unit 3 instructs the motor driving unit 5 to stop rotation of the fixing roller 9.

The CPU control unit 3 then displays a state (e.g., a discharge delay, jam processing, or error) on a display unit 10, and halts the operation of the image forming apparatus main body. When the CPU control unit 3 detects the occurrence of a jam in the fixing unit 370, the CPU control unit 3 records the occurrence of the discharge delay (the occurrence of the jam) in a storage unit 4. A predetermined jam processing operation must be performed to cancel the operation stop state.

A door open/closed detection unit 7 detects the open/closed state of the door of the image forming apparatus. A fixing Unit loading/unloading detection unit 8 can detect whether the fixing unit comprising the fixing unit 370 is unloaded/loaded from/in the image forming apparatus main body. A timer 11 can measure, from the start of image formation, a time for determining whether a jam has occurred. The CPU control unit 3 compares the time measured by the timer 11 with a reference time for determining whether a jam occurs, and can determine whether a jam has occurred. When the measured time is longer than the reference time, the CPU control unit 3 determines that a jam has occurred. However, when the measured time is less than or equal to the reference time, the CPU control unit 3 determines that the recording medium 2 is being normally conveyed.

The jam processing operation procedure will be described next with reference to the flowchart shown in FIG. 2. Note that the jam processing operation is executed under the overall control of the CPU control unit 3.

In step S101, image formation starts. In order to detect the occurrence of a jam, the CPU control unit 3 causes the timer 11 to start measuring a time for determining the occurrence of a jam, at a timing synchronous with the start of image formation.

In step S102, the CPU control unit 3 determines whether the discharge detection unit 6 detects the recording medium 2 within the reference time for determining the occurrence of a jam. When the CPU control unit 3 determines that the discharge detection unit 6 has detected the recording medium 2 within the reference time (when no discharge delay occurs), it determines that the image forming apparatus is operating normally (NO in step S202), and the process advances to step S207. In step S207, an image formation task continues. After the image formation task has completed, the image forming apparatus shifts to the standby state (S208), and the process ends.

On the other hand, when the CPU control unit 3 determines in step S202 that a discharge delay has been detected (YES in step S202), the process advances to step S203.

In step S203, the CPU control unit 3 records, in the storage unit 4, information indicating that a discharge delay and jam have occurred (jam information).

In step S204, the CPU control unit 3 displays, on the display unit 10, information indicating that the discharge delay and jam have occurred (jam information) . The CPU control unit 3 causes the image forming apparatus to shift to the standby state and wait for the jam processing operation to be executed by a user. In this state, the CPU control unit 3 instructs the motor driving unit 5 to stop rotation of the fixing roller 9 and halt the operation of the image forming apparatus main body including conveyance of the recording medium 2.

After the user has executed the jam processing operation (YES in step S205), the process advances to step S206. The CPU control unit 3 erases (clears) the jam information from the storage unit 4, and cancels the operation stop state of the image forming apparatus main body. The CPU control unit 3 then switches the display unit 10 from the jam information display to an operable state notification display.

When the user does not execute the jam processing operation (NO in step S205), the CPU control unit 3 shifts the image forming apparatus to the standby state while holding the information recorded in the storage unit 4, holding the jam information displayed on the display unit 10, and halting the operation of the image forming apparatus main body.

After canceling the jam state (S206), the process advances to step S207, and the image formation task continues (S207). After the image formation task is complete, the image forming apparatus shifts to the standby state (S208), and the process ends.

Figure 2:
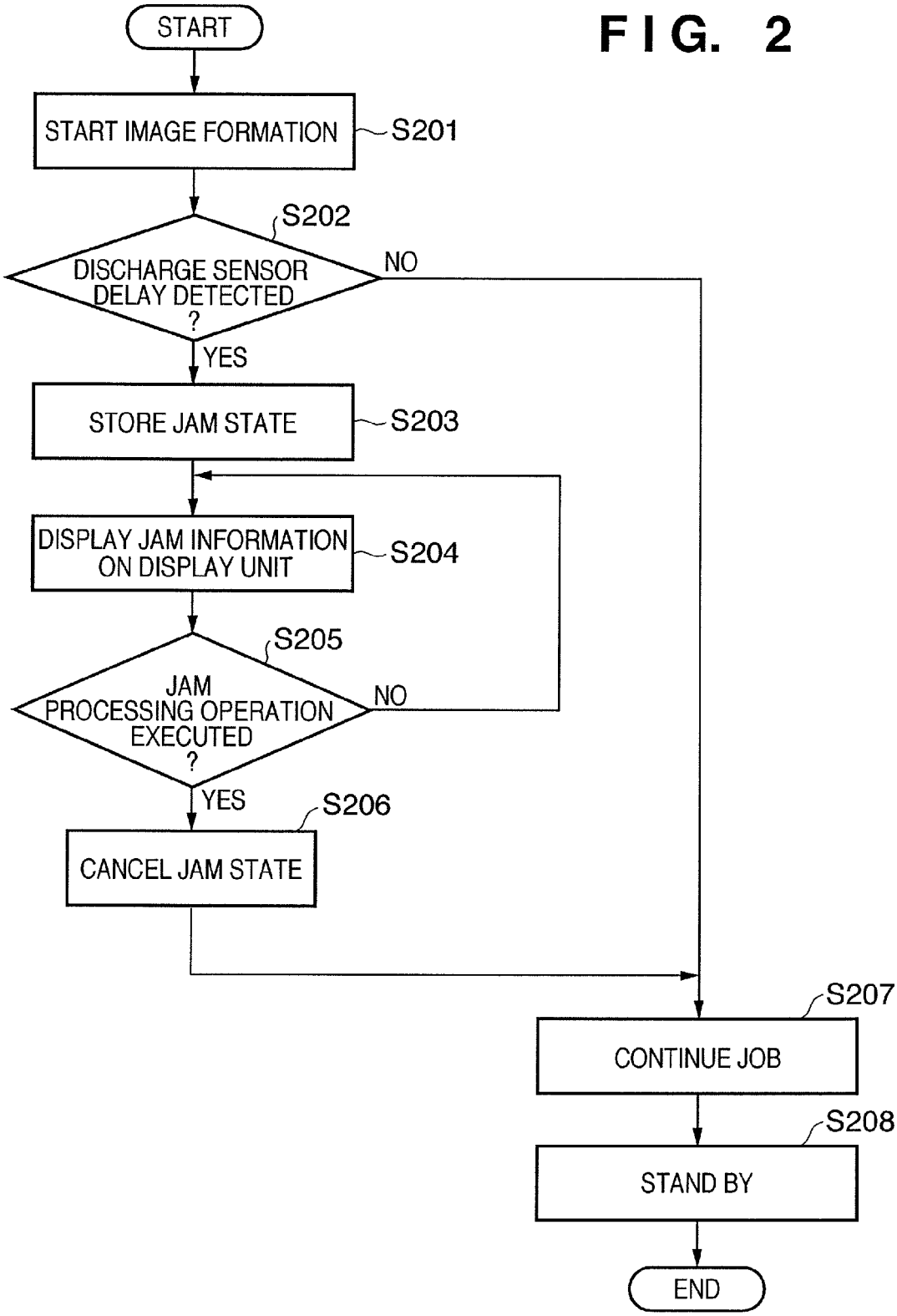
FIG. 2 is a flowchart for explaining the sequence of a jam process operation according to the embodiment of the present invention.
Figure 3:
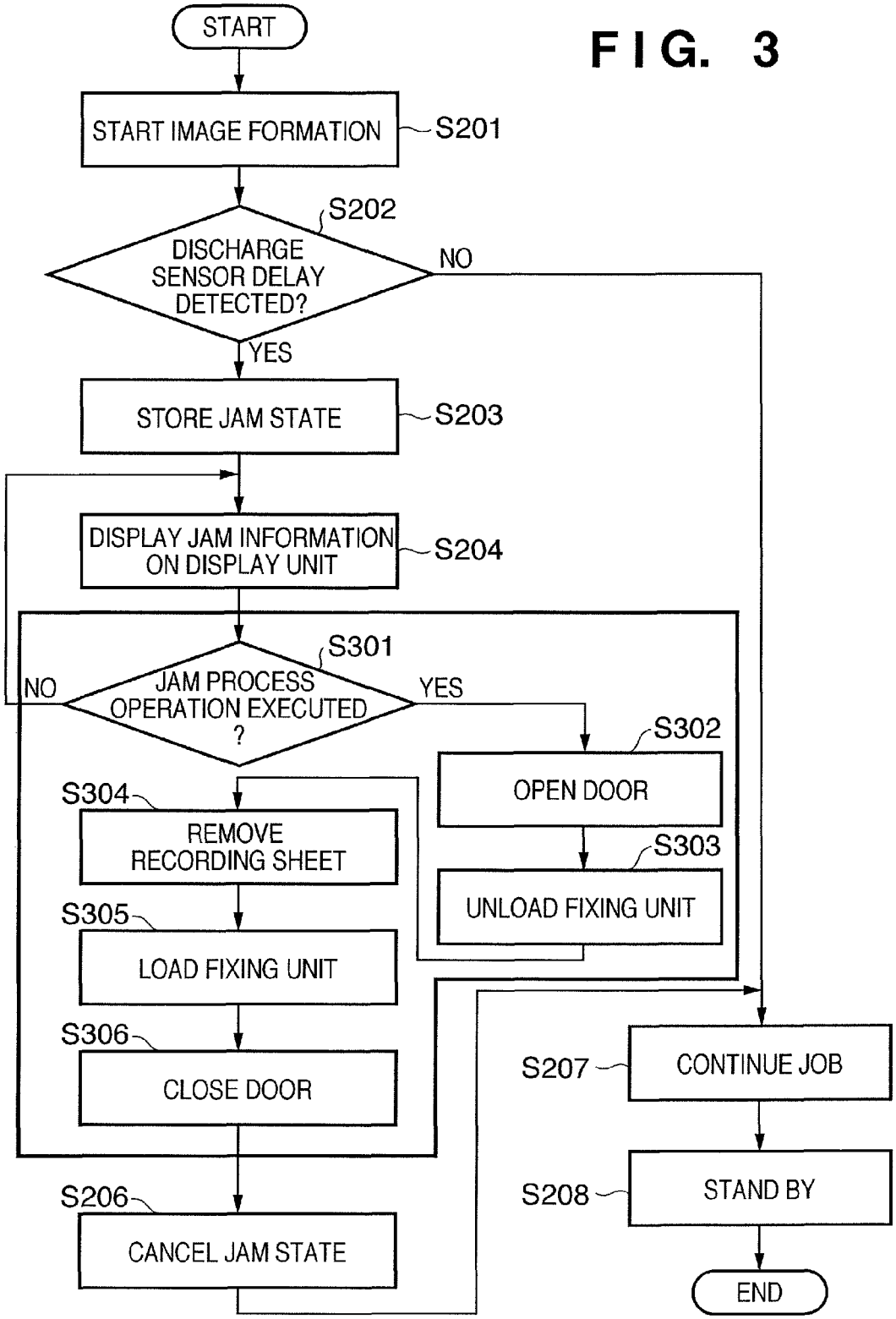
FIG. 3 is a flowchart for explaining the sequence of the jam process operation according to the embodiment of the present invention.

FIG. 3 is a flowchart for specifically explaining the procedure of the jam processing operation in FIG. 2. This process is executed under the overall control of the CPU control unit 3. The same processing as in FIG. 2 is denoted using the same step numbers in FIG. 3, and a repetitive description thereof will be omitted.

When the display unit 10 displays jam information (8204), the user is notified that a jam has occurred.

When the user executes the jam processing operation in step S301 (YES in step S301), the process advances to step S302.

On the other hand, if the user does not execute the jam processing operation (NO in step S301) the CPU control unit 3 shifts the image forming apparatus to the standby state while holding the information recorded in the storage unit 4, holding the jam information displayed on the display unit 10, and halting the operation of the image forming apparatus main body.

In step S302, based on the detection result of the door open/closed detection unit 7 (FIG. 1), the CPU control unit 3 detects that the user has opened the door of the image forming apparatus in the jam processing operation. In step S303, based on the detection result of the fixing unit loading/unloading detection unit 8 (FIG. 1), the CPU control unit 3 detects that the fixing unit including the fixing unit 370 has been unloaded.

In step S304, the jammed recording medium 2 is unloaded by the jam processing operation performed by the user and removed from the fixing unit. Based on the detection result of the discharge detection unit 6, the CPU control unit 3 can detect that the recording medium 2 has been removed. The cause of the jam is eliminated by removing the recording medium 2, and the fixing unit from which the recording medium 2 has been removed is loaded into the image forming apparatus main body.

In step S305, based on the detection result of the fixing unit loading/unloading detection unit 8 (FIG. 1), the CPU control unit 3 detects that the fixing unit has been loaded in the image forming apparatus main body. In step S806, based on the detection result of the door open/closed detection unit 7 (FIG. 1), the CPU control unit 3 detects that the door of the image forming apparatus is closed. Upon detecting that the door of the image forming apparatus is closed, the CPU control unit 3 determines that the predetermined jam processing operation has been executed sequentially. The process advances to step S206. When the jam state is canceled (S206), the process advances to step S207, and the image formation job continues (S207). After the image formation task ends, the image forming apparatus shifts to the standby state (S208), and the process ends.

Figure 5:
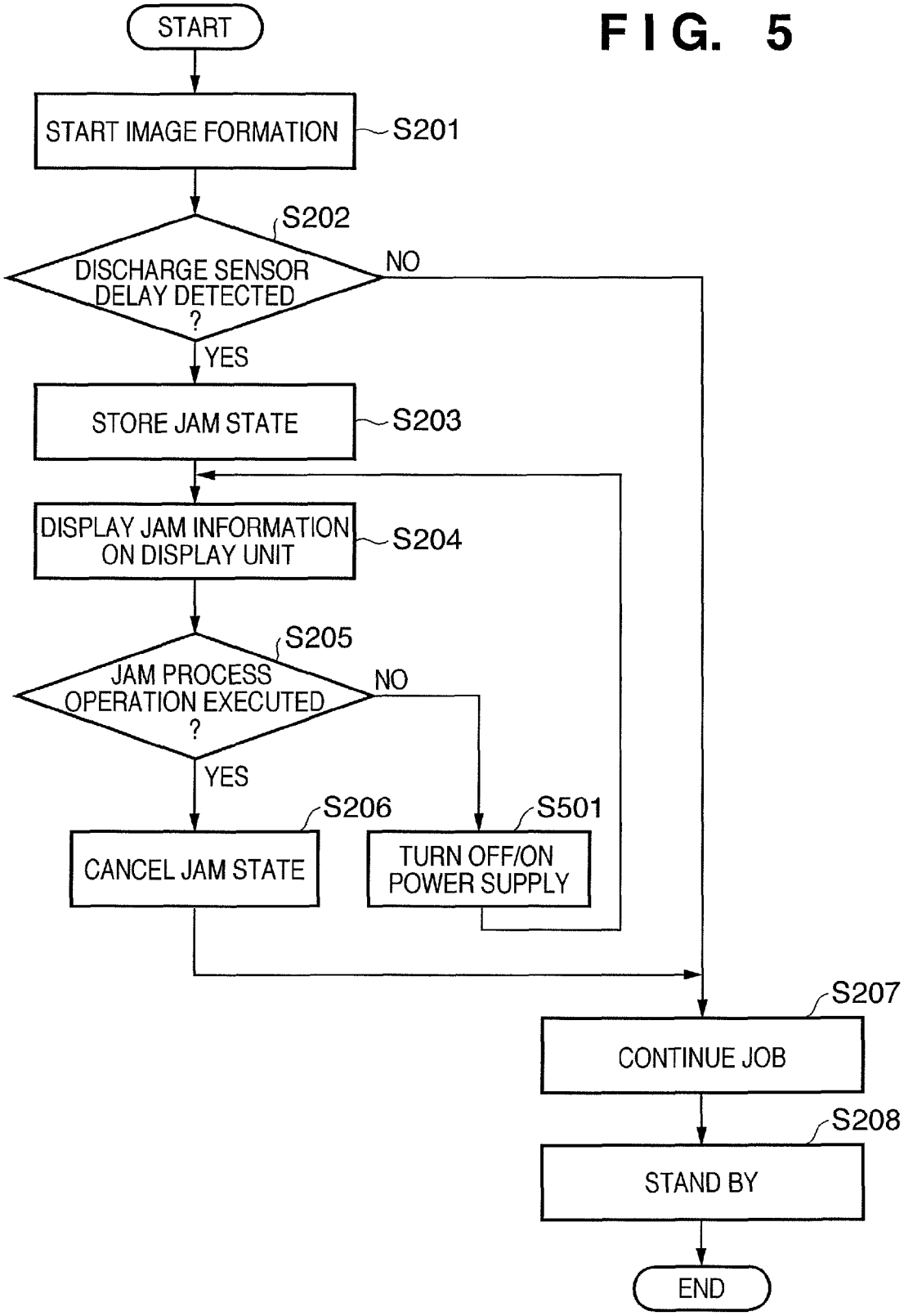
FIG. 5 is a flowchart for explaining the sequence of the jam process operation according to the embodiment of the present invention.

FIG. 5 is a flowchart for explaining the control of the CPU control unit 3 when the image forming apparatus is turned off and then on between steps S203 and S205 shown in FIG. 2. Referring to FIG. 5, step S501 is added between the steps S203 and S205 in the flowchart shown in FIG. 2. This process is executed under the overall control of the CPU control unit 3. Note that the same step numbers denote the steps that execute the same processing as in FIG. 2, and a repetitive description thereof will be omitted.

Even when the image forming apparatus is power-cycled while holding the jam information recorded in the storage unit 4 and that displayed on the display unit 10 and while halting the operation of the image, forming apparatus, the CPU control unit 3 will maintain the standby state. When the CPU control unit 3 does not determine that the predetermined jam processing operation has been executed in sequence, it maintains the operation stop state of the image forming apparatus based on the jam occurrence record in the storage unit 4. When the CPU control unit 3 determines that the predetermined jam processing operation has been executed in sequence, it erases the jam occurrence record from the storage unit 4, and cancels the operation stop state of the image forming apparatus.

The CPU control unit 3 locks the fixing unit into the jam state (standby state) in software using the sensor arranged on the discharge side of the fixing unit, and prevents the apparatus from being used (operated). This jam state is not canceled by power-cycling the power supply, unlike in the conventional technique, and continues until the predetermined jam processing (e.g., opening the door→unloading the fixing unit→(removing the recording sheet)→loading the fixing unit→closing the door) is performed. Since whether a jammed sheet was removed cannot be determined only by detecting that the door was opened and closed, the predetermined jam processing (jam processing operation) is detected. That is, the CPU control unit 3 also detects whether the fixing unit was unloaded and is loaded (depending on the arrangement of the apparatus, the unit 3 detects not whether the fixing unit was unloaded, but whether a nip was released and is formed between the fixing roller and the pressurizing roller). With this operation, the jam state is canceled after detecting the predetermined jam processing. Then, the use of the apparatus is permitted, thereby preventing a recording medium from winding around the fixing roller in the image forming apparatus (especially, high-speed apparatuses). That is, since the CPU control unit 3 maintains the standby state, the recording medium which stays near the fixing roller is prevented from winding around the roller in the fixing unit upon canceling the standby state after power-cycling the power supply (turning the image forming apparatus off and on again) without eliminating the cause of a jam.

According to this embodiment, the image forming technique can prevent a recording medium from winding around the fixing roller. In this embodiment, the image forming technique is suitable for an image forming apparatus having a processing capability of 80 sheets per minute.

Alternatively, according to this embodiment, since the image forming technique can prevent a recording medium from winding around the roller of the fixing unit, the surface of the roller in the fixing unit can be prevented from being damaged. Also, the sensor arranged on the receiving side of the fixing unit becomes unnecessary, resulting in a decrease in the cost of the image forming apparatus.

(Other Embodiments)

The object of the present invention is achieved even by supplying a storage medium which stores software program codes for implementing the functions of the above-described embodiment to the system or apparatus and causing the computer (or a CPU or MPU) of the system or apparatus to read out and execute the program codes stored in the storage medium.

In this case, the program codes read out from the storage medium implement the functions of the above-described embodiment by themselves, and the storage medium which stores the program codes constitutes the present invention.

Examples of the storage medium to supply the program codes are a flexible disk, hard disk, optical disk, magneto optical disk, CD-ROM, CD-R, nonvolatile memory card, and ROM.

The functions of the above-mentioned embodiment may be implemented by executing the read-out program code by the computer and implemented by some or all of actual processing operations executed by an OS (operating system) running on the computer on the basis of the instructions of the program code.

While the present invention has been described with reference to exemplary embodiments, it is to be understood that the invention is not limited to the disclosed exemplary embodiments. The scope of the following claims is to be accorded the broadest interpretation so as to emcompass all such modifications and equivalent structures and functions.

This application claims the benefit of Japanese Patent application No. 2006-162805, filed Jun. 12, 2006, Which is hereby incorporated by reference herein in its entirety.

What is claimed is:

1. an image forming apparatus comprising:

a fixing unit configured to have a rotating member for providing heat to a recording medium and fixes a toner image onto the recording medium by the heat provided from the rotating member;

a sensor configured to be arranged at a downstream position from said fixing unit and detects the recording member;

a jam detection unit configured to detect a occurrence of a jam in a case where the recording medium is not detected by said sensor at a predetermined timing, and stop a rotation of the rotating member;

a storage unit configured to store jam information for indicating the occurrence of the jam in a case where the occurrence of the jam is detected by said jam detection unit;

a loading/unloading detection unit configured to detect whether or not said fixing unit is unloaded/loaded from/in the image forming apparatus;

a jam cancellation unit configured to erase the jam information stored in said storage unit in a case where the cancellation of the jam has been detected, wherein in a case where the occurrence of the jam has been detected by said jam detection unit, that the unloading of said fixing unit and the loading of said fixing unit have been detected is a condition for determining whether the jam has been canceled, wherein, if the image forming apparatus is turned on after the image forming apparatus has been turned off, in a case where said loading/unloading detection unit does not detect the unloading of said fixing unit and the loading of said fixing unit that has been unloaded, said jam cancellation unit does not erase the jam information of the jam detected by said jam detection unit at the predetermined timing prior to the image forming apparatus being turned off, and said jam detection unit maintains a state of a stop of the rotating member.

2. The apparatus according to claim 1, further comprising an open/closed detection unit configured to detect whether a door of the image forming apparatus to be opened in order to unload said fixing unit is opened, wherein that (i) an open state of the door of the image forming apparatus, (ii) the unloading of said fixing unit and the loading of said fixing unit, and (iii) a close state of the door of the image forming apparatus, have been detected is a condition for determining whether the jam has been canceled.

* * * * *